US006234482B1

(12) United States Patent
Henderson

(10) Patent No.: US 6,234,482 B1
(45) Date of Patent: May 22, 2001

(54) METHOD FOR PLAYING A DICE GAME

(76) Inventor: Thomas S. Henderson, P.O. Box 2777, Laughlin, NV (US) 89029

( * ) Notice: Subject to any disclaimer, the term of this patent is extended or adjusted under 35 U.S.C. 154(b) by 0 days.

(21) Appl. No.: 09/354,940

(22) Filed: Jul. 15, 1999

(51) Int. Cl.[7] ..... A63F 3/00

(52) U.S. Cl. ..... 273/274; 273/309; 273/139

(58) Field of Search ..... 273/138.1, 139, 273/309, 274, 268, 143 A, 146, 236

(56) References Cited

U.S. PATENT DOCUMENTS

| | | | |
|---|---|---|---|
| 4,312,508 | | 1/1982 | Wood . |
| 5,133,559 | | 7/1992 | Page . |
| 5,265,881 | | 11/1993 | Doherty . |
| 5,350,175 | | 9/1994 | DiLullo . |
| 5,364,101 | | 11/1994 | Spooner . |
| 5,405,145 | | 4/1995 | Jones . |
| 5,456,467 | | 10/1995 | Hoover . |
| 5,542,671 | | 8/1996 | Stewart . |
| 5,806,847 | * | 9/1998 | White et al. . |
| 5,879,006 | * | 3/1999 | Bowling . |
| 5,997,000 | * | 12/1999 | Nakano . |

OTHER PUBLICATIONS

John Scarne, Scarne on Dice, pp. 336–341, Wilshire Book Company.

Pyramid Dice, Pamphlet distributed at Circus Circus, Las Vegas Nevada.

* cited by examiner

*Primary Examiner*—Benjamin H. Layno
*Assistant Examiner*—Vishu Mendiratta
(74) *Attorney, Agent, or Firm*—Philip J. Anderson; Anderson & Morishit

(57) ABSTRACT

A dice game utilizing three dice begins with players making at least one of a single roll wager or a multiple roll wager. Single roll wagers are resolved after each roll of the dice. The single roll wagers include group wagers in which players wager on mutually exclusive groups of sums, each group having substantially the same probability of winning. Multiple roll wagers may require several rolls of the dice to be resolved because, if the number rolled is neither a predetermined losing outcome nor the outcome wagered upon, the wager is neither collected nor paid and an additional roll is required to resolve the wager. A shooter shoots the dice and the numbers facing upward on the dice are noted. Additionally, the numbers are summed. The wagers are then resolved. A jackpot wager is available to the shooter without the shooter making any additional wager. The shooter wins the jackpot by rolling a predetermined combination of numbers in a predetermined sequence of at least two consecutive rolls of the dice.

7 Claims, 2 Drawing Sheets

METHOD FOR PLAYING A DICE GAME

FIELD OF THE INVENTION

The present invention relates to a dice game. Specifically, the present game is a dice game with a jackpot payout in which players may wager on a single roll of the dice or multiple rolls of the dice.

BACKGROUND OF THE INVENTION

Dice games are well known in the art. Two of the most well known dice games are Craps and Sic Bo. In Craps, players place multiple roll wagers on the sum of the dice, single roll wagers on the sum of the dice, and multiple roll wagers on the combination of numbers shown on the face of the dice. For example, a pass line wager is paid when a natural, i.e. a seven or eleven, is rolled on the initial, or come out, roll or a point number, i.e. four, five, six, eight, nine, or ten, is rolled on the come out roll and then repeated before rolling a seven. The pass line wager is collected if a craps, i.e. two, three, or twelve, is rolled on the come out roll or a point number is rolled and a seven is rolled before the point number is repeated.

Conversely, a don't pass line wager is paid when a craps is rolled on the come out roll or a point number is rolled and a seven is rolled before the point number is repeated. The don't pass line wager is collected if a natural is rolled on the come out roll or a point number is rolled and then repeated before rolling a seven. A wager related to the pass line wager and the don't pass line wager is the free odds wager. Should a shooter roll a point number on the come out roll, any player with a pass line wager may place an additional free odds wager which will be paid at actual odds if the point number is rolled before a seven. For example, if the point number is six, a player with a free odds wager will be paid at 6:5 if the shooter rolls a six before rolling a seven. Likewise, any player with a don't pass line wager may place an additional wager which will be paid at actual odds if a seven is rolled before the point number. Thus, if the point number is six, a player with a free odds wager will be paid at 5:6 if the shooter rolls a seven before rolling a six.

A come wager and a don't come wager are treated similarly to the pass wager and don't pass wager, respectively, with the roll immediately following the placing of the wager treated as the come out roll for the come and don't come wagers.

Other possible wagers include place, or box, wagers in which a player wagers that a selected number will be rolled before a seven is rolled. The player may also choose to bet the converse, that is, that a seven will be rolled before a selected number is rolled. Yet another wager is the hardway wager in which a player wagers that the next roll of a selected sum will include double numbers. For example, the ten hardway wager is paid if the next ten rolled includes two fives and collected if the next ten rolled includes a four and a six. A hardway wager is also collected if a seven is rolled before a winning roll is rolled. Finally, a player may wager on a group of single roll sums. These single roll wagers include the field wager on the numbers two, three, five, nine, ten, eleven, and twelve and wagers on various other sums and dice combinations such as any craps, any sevens, two aces, two sixes, and the like.

Sic Bo is a single roll dice game in which players may wager on the sum of the dice. For example, the player may wager on the sum of fifteen without regard to the combination of dice required to form a fifteen, i.e. the wager would win if the dice show 5-5-5, 4-5-6, or 3-6-6. Alternatively or additionally, the player may wager on the combination of dice, for example, wagering on the combination of 5-5-5. Three dice are rolled and all wagers are immediately resolved; that is, there are no multiple roll wagers in Sic Bo.

The drawback of these games is that there is no opportunity to receive a large bonus. Moreover, there is no wager in Craps or Sic Bo on a subgroup of sums wherein each group is mutually exclusive and each group has substantially the same probability of winning.

Thus, there is a need in the art for a dice game which includes a jackpot payout and wagers on a single roll of the dice or on multiple rolls of the dice wherein the wagers are paid or collected based on the sum of the dice and the combination of numbers showing on the dice.

SUMMARY OF THE INVENTION

Three dice, or electronic representations thereof, are provided for the game of the present invention. The dice are preferably cubical with numerical indicia on each face.

The players place single roll wagers and multiple roll wagers on a table layout. Single roll wagers, as the name implies, are resolved after each roll of the dice. In the game of the present invention, as few as one single roll wager, the group wager, could be provided. However, the preferred embodiment contemplates a plurality of single roll wagers to retain player interest. In a group wager, players wager on one of a plurality of mutually exclusive groups of sums having substantially the same probability of containing the number rolled. In other words, the groups are constructed such that there is substantially the same probability that any of the groups will be a winner on each roll. The group wagers are paid when a sum in the group wagered upon is rolled and collected when any other sum is rolled. Other single roll wagers could include wagers on consecutive numbers on the three dice, the size of the sum of the numbers rolled, and whether any of the dice include matching numbers.

Additionally, the game of the present invention includes at least one multiple roll wager. Multiple roll wagers, as the name implies, may require multiple rolls of the dice to be resolved. That is, if the outcome wagered upon occurs, the multiple roll wager is paid. Conversely, if a designated losing outcome occurs, the multiple roll wager is collected. If neither a winning nor losing outcome is rolled, the multiple roll wager is neither paid nor collected. When this occurs, the player may leave the wager for the next roll, remove the wager from the layout, or increase or decrease the amount wagered. In a preferred embodiment, multiple roll wagers are placed on the sum of the numbers. That is, a player making a multiple roll wager selects a sum from all possible sums excluding at least one predetermined losing sum.

After the wagers are placed, a shooter is designated from among the players who placed a wager. The shooter rolls the dice and the numbers showing on the faces of the dice are noted. Additionally, the numbers are summed. The single roll wagers and multiple roll wagers are resolved as described above.

Additionally, the present game provides a jackpot. Only the shooter is eligible for the jackpot. However, the shooter need not make a wager in addition to the shooter's single roll or multiple roll wager to be eligible for the jackpot. The shooter wins the jackpot by rolling a predetermined combination of numbers in a predetermined sequence of at least two consecutive rolls of the dice. In a preferred embodiment, the jackpot includes a plurality of predetermined sequences, each sequence having a different payoff depending on the probability of the sequence occurring.

It is an object of the present invention to provide a dice game in which a jackpot payout is available to the shooter without requiring the shooter to make an additional jackpot wager. Another object of the present invention is to provide a dice game in which both single roll wagers and multiple roll wagers are available to the players. Also, it is an object of the present invention is to provide a dice game in which a player may wager on the sum of the dice or the combination of numbers on the dice.

DESCRIPTION

Figure 1:
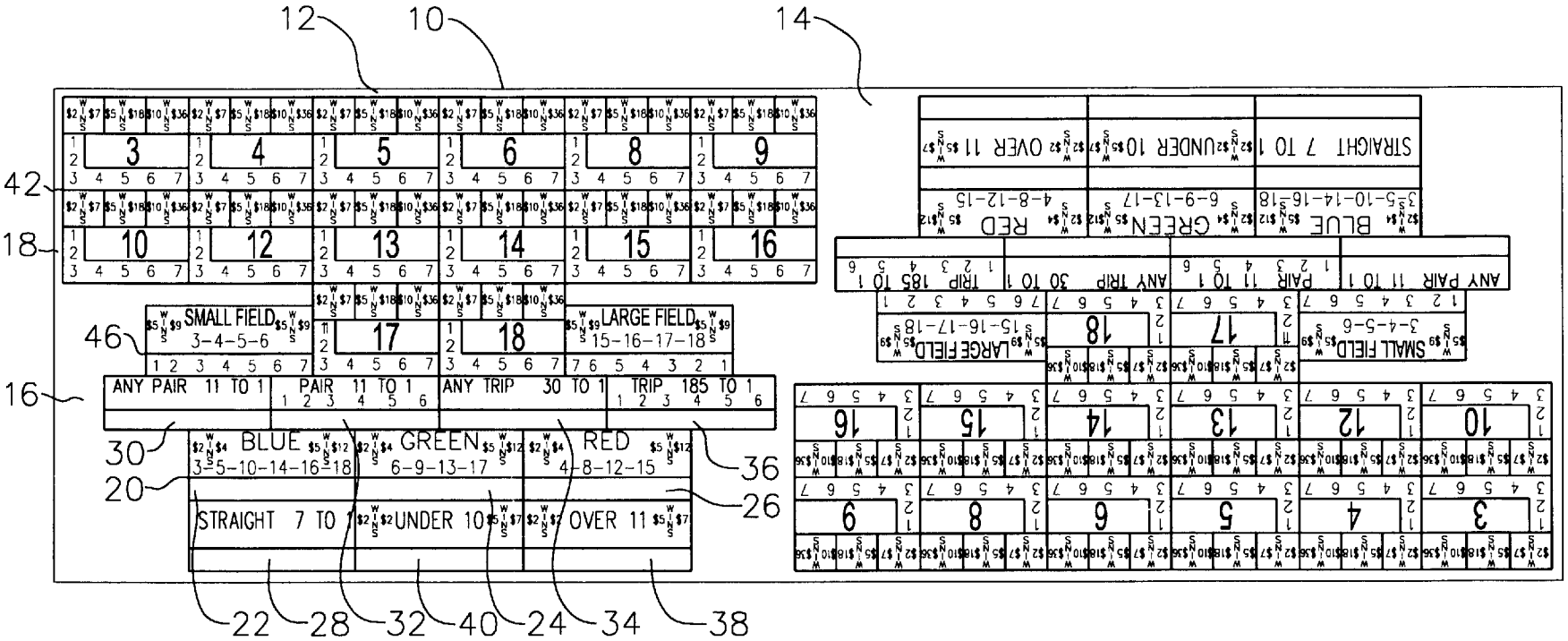
FIG. 1 is a top view of the layout of according to an embodiment of the present invention.

Reference is now made to the figures wherein like parts are referred to by like numerals throughout. Referring to FIG. 1, the layout 10 of the present invention has reflection-inversion symmetry. That is, one side of the layout 10 is an inverted reflection of the opposite side of the layout 10. This allows players on either side of the table to easily place wagers on the layout 10. A plurality of boxes 12 are marked on the layout 10 where players may place gaming chips to designate their wagers. The layout 10 includes a dealer area 14 from which the dealer may pay winning wagers, collect losing wagers, distribute gaming chips, and the like.

These boxes 12 include at least one single roll wager 16 and at least one multiple roll wager 18. Although the game requires only one single roll wager 16, the group wager 20, in a preferred embodiment a plurality of single roll wagers 16 are provided to maintain player interest. That is, a number of different single roll wagers 16 may be provided so that the player does not become bored with the game. As the name indicates, single roll wagers 16 are wagers which are placed before rolling dice and are resolved after each roll. In other words, single roll wagers 16 are immediately paid or collected after each roll.

In the group wager 20, the possible sums, excluding predetermined losing sums, are divided into a plurality of groups 20 such that the probability of rolling a sum in any one group 20 is substantially the same. The purpose of this is to insure that players are equally likely to win regardless of which group 20 is selected, thus providing the casino banking the game with predictability.

For example, in a game using three cubical dice with sides numbered one through six, the possible sums are three through eighteen inclusive. If the designated losing outcomes are seven and eleven, the sums could be divided into three groups 20—four, eight, twelve, fifteen; six, nine, thirteen, seventeen; and three, five, ten, fourteen, sixteen, eighteen. In a single roll, the probability that a sum will be contained in one of these three groups 20 is substantially the same because there are fifty-six ways to roll a total in the first group 22, fifty-nine ways to roll a total in the second group 24, and fifty-nine ways to roll a total in the third group 26. It can be seen that an infinite number of groupings is possible given that the only requirements are that there be at least one designated losing sum excluded from the groupings and that the remaining sums be divided into at least two groups 20 having substantially the same probability of containing a sum rolled. In a preferred embodiment, each group 20 is designated with a different color 22, 24, 26 on the layout 10.

It is contemplated that many other single roll wagers 16 on the sum of the dice or the combination of numbers showing on the dice may be possible. For example, a player may wager on the sum of the dice, whether the sum is odd or even, and the like. One possible single roll wager 16 is a straight wager 28. In a straight wager 28, the player is rewarded if the three dice show consecutive numbers. For example, if the numbers rolled are 2-3-4, the straight wagers 28 are paid. If the numbers rolled are non-consecutive, the straight wagers 28 are collected.

Another single roll wager 16 which could be provided is a wager on whether two or more of the dice include matching numbers. For example a pairs wager 30 could be provided in which a wagering player wins if exactly two of the dice have matching numbers such as a roll of 2-2-5. A variation on this wager is a called pairs wager 32 in which the player must designate, or call, which number will appear on both dice. Likewise, a trips wager 34 and a called trips wager 36 may be provided for players to wager that all three dice will have matching numbers.

Yet another single roll wager 16 which could be provided is a wager on the relative size of the sum. For example, an over wager 38 could be provided in which the player wagers that the sum will exceed eleven. Likewise, an under wager 40 could be provided in which the player wagers that the sum will be less than ten.

In a preferred embodiment, the single roll wagers 16 are paid according to Table 1.

TABLE 1

| Wager | Payout |
|---|---|
| Over 11 or Under 10 | $2 wager wins $2<br>$5 wager wins $7 |
| Group wager with three groups | $2 wager wins $4<br>$5 wager wins $12 |
| Straight | 7 to 1 |
| Any pair | 1 to 1 |
| Called pair | 11 to 1 |
| Any trip | 30 to 1 |
| Called trip | 185 to 1 |

The game of the present invention also contemplates at least one multiple roll wager 18. As the name indicates, a multiple roll wager 18 is a wager which may require more than one roll to resolve the wager. In other words, some outcomes, designated as losing outcomes, result in the loss of the wager; the outcome wagered upon is a winning outcome; and any other outcome does not affect the wager.

While the multiple roll wager 18 could be a wager on the combination of numbers rolled, in a preferred embodiment, the multiple roll wager 18 is a wager on the sum of the dice and is referred to as a totals wager 42. Thus, in a preferred embodiment, the sums seven and eleven are designated losing outcomes. Any other sum may be wagered upon. If the shooter rolls a seven or eleven, all multiple roll wagers 18 are collected by the casino. If the shooter rolls any other sum, players wagering upon the sum rolled are rewarded. The other wagers are neither rewarded nor collected. In a preferred embodiment, after each roll, a player with an unaffected wager may leave the wager on the layout 10 or may increase, decrease, or remove the wager. For example, if the designated losing sums are seven and eleven, and a player wagers on nine, his wager is unaffected until the shooter rolls a seven, nine, or eleven. When the shooter rolls a sum other than seven, nine, or eleven, the player wagering on nine may leave the wager on nine, or increase, decrease, or remove the wager.

Another multiple roll wager 18 which may be offered is a field wager in which a player may wager on a group of sums rather than a single sum. In a preferred embodiment, two field wagers are available: a large field wager 44 for the sums fifteen, sixteen, seventeen, and eighteen and a small field wager 46 for the sums three, four, five, and six.

In a preferred embodiment, multiple roll wagers 18 on the sum of the dice are paid according to the probability that the sum will be rolled. That is, the less likely sums are paid at a higher rate than the more likely sums as shown in Table 2.

TABLE 2

| Sum wagered upon | Payoff for $2 wager | Payoff for $5 wager | Payoff for $10 wager |
|---|---|---|---|
| 3 or 18 | $72 | $180 | $360 |
| 4 or 17 | $24 | $60 | $120 |
| 5 or 16 | $12 | $30 | $60 |
| 6 or 15 | $7 | $18 | $36 |
| 14 | $4 | $12 | $24 |
| 8 or 13 | $3 | $8 | $16 |
| 9 or 12 | $2 | $7 | $14 |
| 10 | $2 | $6 | $13 |
| Small and large field | | $9 | |

After the players place their wagers, a shooter is designated from among the wagering players and the shooter rolls three dice. While the preferred embodiment contemplates cubical, six-sided dice, dice with any number of sides could be used. Moreover, electronic representations of dice, such as a processor which randomly selects numbers from a data structure storing the numbers one through six, could substitute for physical dice. Thus, the game could be played on an electronic machine, a personal computer, a computer network, such as the Internet, or the like. After three numbers are obtained through random selection, the numbers are noted and the sum of the numbers is calculated. The single roll wagers 16 and multiple roll wagers 18 are resolved as described above.

The game of the present invention also includes a jackpot payout. The jackpot payout is available to the shooter only. No other player shares in the jackpot payout. However, the jackpot is available to the shooter without the shooter making any wager other than a single roll wager 16 or a multiple roll wager 18. In other words, the shooter does not need to make a jackpot wager to be eligible for the jackpot payout; the shooter is eligible merely by being the shooter.

Figure 2:
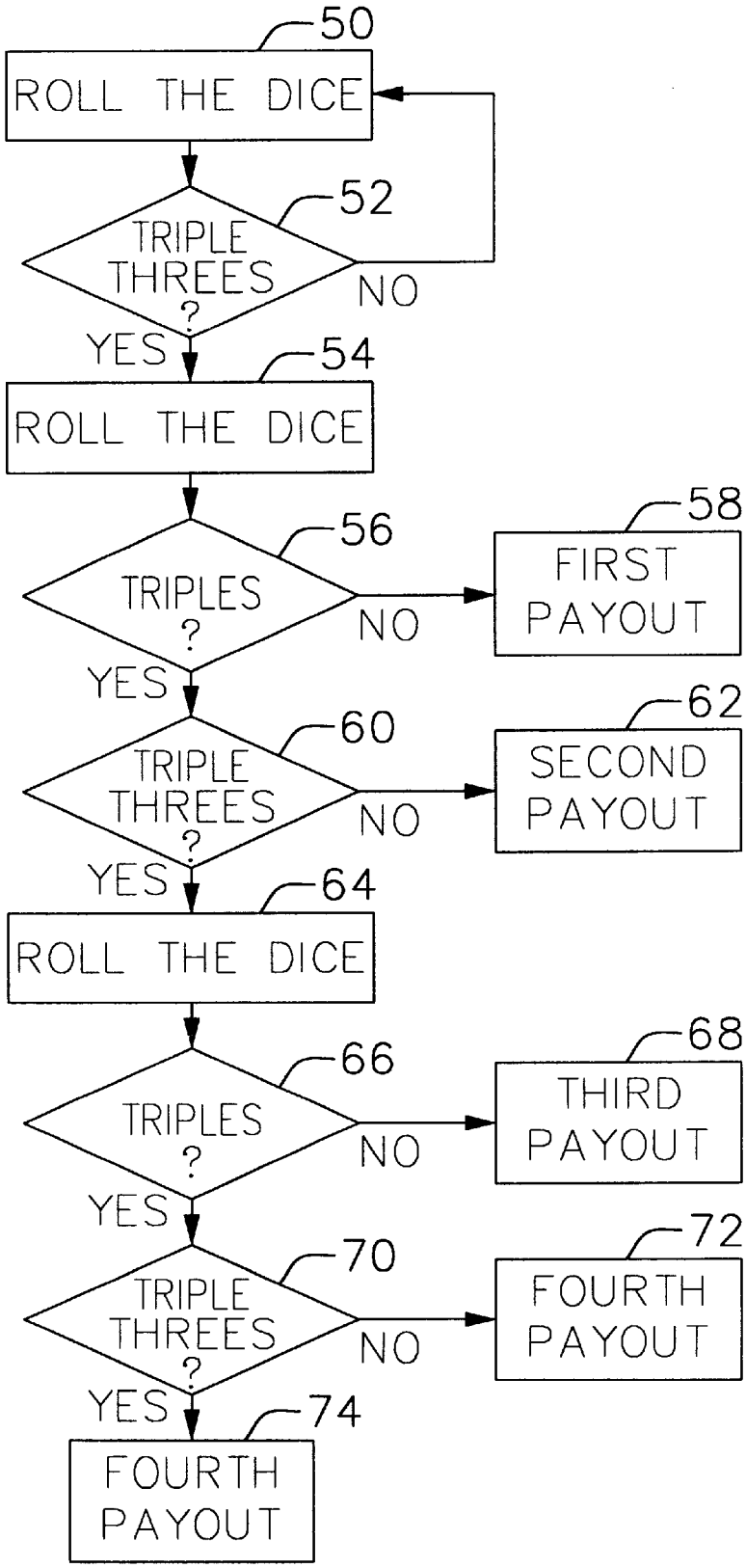
FIG. 2 is a flow chart of the jackpot payout according to an embodiment of the present invention.

The jackpot is won by rolling a predetermined combination of numbers in a predetermined sequence of at least two rolls. The predetermined combination could be any of a variety of possible combinations. Likewise, any pay table could be used to reward jackpot rolls. However, FIG. 2 shows a schematic of the preferred embodiment of the jackpot payout. A player becomes eligible for the jackpot by rolling 50 three threes 52. If the shooter rolls a non-triple 56 on the second roll 54, the shooter wins a first payout 58 and the shooter's jackpot play ends. If the shooter rolls a triple 56 other than threes on the second roll 54, the shooter wins a second payout 62 greater than the first payout 58 and the shooter's jackpot play ends. If the shooter rolls three threes 60 on the second roll 54, the shooter is eligible for a jackpot payout on the third roll 64. If the shooter rolls a non-triple 66 on the third roll 64, the shooter wins a third payout 68 greater than the second payout 62 and the shooter's jackpot play ends. If the shooter rolls a triple 66 other than threes on the third roll 64, the shooter wins a fourth payout 72 greater than the third payout 68 and the shooter's jackpot play ends. If the player rolls three threes 70 for a third time, the player wins a fifth payout 74—the jackpot.

An advantage of the present dice game is that a jackpot payout is available to the shooter without requiring the shooter to make an additional jackpot wager. Another advantage of the present game is that both single roll wagers 16 and multiple roll wagers 18 are available to the players. Yet another advantage of the present invention is players may wager on the sum of the dice or the combination of numbers on the dice.

I claim:

1. A method for playing a dice game utilizing three dice, or electronic representations thereof, having numerical indicia on their faces comprising:

the players making at least one of the following wagers: (1) a single roll wager, said single roll wager including group wagers wherein players wager on a plurality of mutually exclusive groups of sums having 4, 8, 12, 15; 6, 9, 13, 17; 3, 5, 10, 14, 16, 18, said group wagers being paid when a sum in the group wagered upon is rolled and collected when any other sum is rolled or (2) a multiple roll wager;

designating a shooter from among the wagering players to roll said dice;

the shooter rolling said dice;

determining the numbers showing on the faces of said dice and summing the numbers;

for each player making a single roll wager, paying the player based on the amount wagered if the single roll outcome wagered upon is rolled, otherwise collecting the player's single roll wager;

for each player making a multiple roll wager, paying the player based on the amount wagered if the multiple roll outcome wagered upon is rolled, collecting the multiple roll wager if a predetermined losing outcome is rolled, and neither collecting nor paying the multiple roll wager if any other outcome is rolled; and paying a jackpot to said shooter, without said shooter making any wager in addition to the shooter's multiple roll or single roll wager, when the shooter rolls a predetermined combination of numbers in a predetermined sequence, said sequence comprising at least two consecutive rolls of the dice.

2. The method of claim 1 wherein said jackpot comprises:

a first sum paid to the shooter when the dice show a predetermined jackpot combination on a first roll and a different predetermined jackpot combination on a second roll.

3. The method of claim 1 wherein said jackpot comprises:

a second sum, said second sum paid to the shooter when the dice show the same predetermined jackpot combination on at least two consecutive rolls.

4. The method of claim 1 wherein said jackpot comprises:

a third sum, said third sum paid to the shooter when the dice show the same predetermined jackpot combination on a first roll and a second roll, and a different predetermined jackpot combination on a third roll.

5. The method of claim 1 wherein said single roll wagers further comprise:

straight wagers wherein straight wagers are paid when dice show consecutive numbers on a single roll and collected when the dice show non-consecutive numbers.

6. The method of claim 1 wherein said multiple roll wagers comprise totals wagers wherein players wager on the sum of the dice, excluding at least one predetermined losing sum, the players being able to increase, decrease, or remove said totals wagers after each roll of the dice.

7. A method for playing a dice game utilizing three dice or an electrical equivalent thereof, each die having six sides numbered one through six, comprising the steps of:

players placing at least one of the following wagers:
(1) a multiple roll wager or
(2) a single roll wager;

designating a shooter to roll said dice, said shooter being selected from the wagering players;

rolling said dice;

determining the numbers showing on the faces of said dice;

calculating the sum of the numbers showing on the faces of said dice;

paying or collecting single roll wagers, said single roll wagers comprising:

over wagers wherein players wagering over are paid when the sum rolled exceeds eleven, said over wagers being collected when the sum rolled is less than twelve;

under wagers wherein players wagering under are paid when the sum rolled is less than ten, said under wagers being collected when the sum rolled is more than nine;

group wagers wherein the possible sums, excluding at least one predetermined losing sum, are divided among three mutually exclusive groups having 4, 8, 12, 15; 6, 9, 13, 17; 3, 5, 10, 14, 16, 18, said group wagers being paid when a sum in the group wagered upon is rolled, otherwise said group wagers being collected;

any pairs wagers wherein players wagering any pairs are paid when exactly two of the dice show the same number, said any pairs wagers being collected when fewer than two or more than two dice show the same number;

called pair wagers wherein a player wagering a called pair is paid when exactly two of the dice show a number specified by said player, said called pairs wagers being collected when fewer than two or more than two dice show the specified number;

any trips wagers wherein players wagering any trips are paid when three dice show the same number, said any trips wagers being collected when fewer than three dice show the same number;

called trips wagers wherein a player wagering called trips is paid when three dice show a number specified by said player, said called trips wagers being collected when fewer than three dice show the specified number;

straight wagers wherein players wagering straight are paid when dice show consecutive numbers, said straight wagers being collected when the dice show non-consecutive numbers; paying or collecting multiple roll wagers said multiple roll wagers comprising:

totals wagers wherein players may wager on the sum of the dice, excluding at least one predetermined losing sum, the totals wagers being paid when the sum rolled equals the sum wagered upon, all of said totals wagers being collected when the sum of the dice is a predetermined losing sum, the totals wagers being neither collected nor paid when any other sum is rolled, said players with totals wagers remaining being able to increase, decrease, or remove said totals wagers before the next roll of the dice; and field wagers wherein players may wager on a group of sums of the dice excluding at least one predetermined losing sum, the field wagers being paid when the sum rolled is in the group of sums wagered upon, all of said field wagers being collected when the sum of the dice is a predetermined losing sum, the field wagers being neither collected nor paid when any other sum is rolled, said players with field wagers remaining being able to increase, decrease, or remove said field wagers before the next roll of the dice; and paying a jackpot to the shooter without said shooter making any wager in addition to the shooter's multiple roll or single roll wager, said jackpot comprising:

a first sum being paid to the shooter when the dice show three threes on a first roll and two of any other number on a second roll;

a second sum being larger than said first sum, said second sum being paid to the shooter when the dice show three threes on a first roll and three of any other number on a second roll;

a third sum being larger than said second sum, said third sum being paid to the shooter when the dice show three threes on a first roll and a second roll, and two of any other number on a third roll;

a fourth sum being larger than said third sum, said fourth sum being paid to the shooter when the dice show three threes on a first roll and a second roll and three of any other number on a third roll;

a fifth sum being larger than said fourth sum, said fifth sum being paid to the shooter when the dice show three threes on a first roll, a second roll, and a third roll.

* * * * *